US009573249B2

(12) United States Patent
Kuntz et al.

(10) Patent No.: US 9,573,249 B2
(45) **Date of Patent: *Feb. 21, 2017**

(54) BORON NITRIDE COMPOSITES

(71) Applicant: Lawrence Livermore National Security, LLC, Livermore, CA (US)

(72) Inventors: Joshua D. Kuntz, Livermore, CA (US); German F. Ellsworth, Livermore, CA (US); Fritz J. Swenson, Tracy, CA (US); Patrick G. Allen, Pleasanton, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/946,606

(22) Filed: Nov. 19, 2015

(65) Prior Publication Data

US 2016/0074997 A1 Mar. 17, 2016

Related U.S. Application Data

(63) Continuation of application No. 14/010,423, filed on Aug. 26, 2013, now Pat. No. 9,259,823.

(51) Int. Cl.

| | |
|---|---|
| ***B24D 3/00*** | (2006.01) |
| ***B24D 3/02*** | (2006.01) |
| ***B24D 11/00*** | (2006.01) |
| ***B24D 18/00*** | (2006.01) |
| ***C09K 3/14*** | (2006.01) |
| ***B24D 3/04*** | (2006.01) |

(52) U.S. Cl.
CPC . *B24D 3/04* (2013.01); *B24D 3/00* (2013.01); *B24D 18/0009* (2013.01)

(58) Field of Classification Search
USPC ..... 51/307, 293, 309
See application file for complete search history.

(56) References Cited

U.S. PATENT DOCUMENTS 4,157,897 A * 6/1979 Keat ..... B24D 3/16 51/295
4,289,503 A * 9/1981 Corrigan ..... B01J 3/062 423/290
5,716,825 A * 2/1998 Hancock ..... B01J 19/0093 250/288

(Continued)

FOREIGN PATENT DOCUMENTS

WO 9850147 A1 11/1998
WO 2009105499 A1 8/2009

OTHER PUBLICATIONS

Kuntz et al., U.S. Appl. No. 14/010,423, filed Aug. 26, 2013.

(Continued)

*Primary Examiner* — James McDonough
(74) *Attorney, Agent, or Firm* — Zilka-Kotab PC

(57) ABSTRACT

According to one embodiment, a composite product includes: a matrix material including hexagonal boron nitride and one or more borate binders; and a plurality of cubic boron nitride particles dispersed in the matrix material. According to another embodiment, a composite product includes: a matrix material including hexagonal boron nitride and amorphous boron nitride; and a plurality of cubic boron nitride particles dispersed in the matrix material.

20 Claims, 6 Drawing Sheets

(56) References Cited

U.S. PATENT DOCUMENTS

| | | | | |
|---|---|---|---|---|
| 6,556,940 | B1 * | 4/2003 | Tretiakov | B01L 7/52 435/286.1 |
| 7,164,077 | B2 | 1/2007 | Venkatasubramanian | |
| 7,332,271 | B2 | 2/2008 | O'Keefe et al. | |
| 7,578,976 | B1 | 8/2009 | Northrup et al. | |
| 7,604,983 | B2 * | 10/2009 | O'Keefe | B01F 13/0071 422/504 |
| 7,669,426 | B2 | 3/2010 | Iovanni et al. | |
| 9,259,823 | B2 * | 2/2016 | Kuntz | B24D 3/00 |
| 2001/0055765 | A1 | 12/2001 | O'Keefe et al. | |
| 2006/0270026 | A1 | 11/2006 | Soh et al. | |
| 2008/0020946 | A1 | 1/2008 | Venkatasubramanian | |
| 2008/0108112 | A1 | 5/2008 | O'keefe et al. | |
| 2009/0023603 | A1 | 1/2009 | Selden et al. | |
| 2009/0203120 | A1 | 8/2009 | Shin et al. | |
| 2009/0291487 | A1 | 11/2009 | Bommer et al. | |
| 2010/0056383 | A1 | 3/2010 | Ririe et al. | |
| 2010/0075330 | A1 | 3/2010 | O'Keefe et al. | |
| 2010/0124766 | A1 | 5/2010 | Ng et al. | |
| 2012/0099971 | A1 * | 4/2012 | Bintz | C23C 28/022 415/173.6 |
| 2015/0052823 | A1 | 2/2015 | Kuntz et al. | |

OTHER PUBLICATIONS

Restriction Requirement from U.S. Appl. No. 14/010,423, dated Jan. 16, 2015.
Non-Final Office Action from U.S. Appl. No. 14/010,423, dated Apr. 9, 2015.
Final Office Action from U.S. Appl. No. 14/010,423, dated Aug. 20, 2015.
Notice of Allowance from U.S. Appl. No. 14/010,423, dated Oct. 30, 2015.

* cited by examiner

BORON NITRIDE COMPOSITES

RELATED APPLICATIONS

This application is a continuation of U.S. patent application Ser. No. 14/010,423, filed Aug. 26, 2013, which is herein incorporated by reference.

The United States Government has rights in this invention pursuant to Contract No. DE-AC52-07NA27344 between the United States Department of Energy and Lawrence Livermore National Security, LLC for the operation of Lawrence Livermore National Laboratory.

FIELD OF THE INVENTION

The present invention relates to a composite material suitable for use in cutting, grinding, drilling and/or polishing media, among other potential uses, and more particularly, this invention relates to a composite material comprising cubic boron nitride.

BACKGROUND

Boron nitride (BN) exists in three crystalline forms: hexagonal boron nitride (hBN), a soft form similar to graphite; cubic boron nitride, a hard zincblende form similar to cubic diamond; and wurtzitic boron nitride (wBN), a hard hexagonal form similar to hexagonal diamond. Hexagonal boron nitride is the softest and most stable of the boron nitride crystalline structures, and is routinely used as a lubricant. Cubic boron nitride has a hardness second only to diamond, and therefore has wide application in machining, grinding, drilling and polishing fields. Moreover, cBN rather than diamond is often preferred when working with ferrous materials, as iron catalyzes the decomposition of diamond at elevated temperatures and carbon can change the phase of many iron alloys. The thermal and chemical stability of cBN is also superior to diamond.

Methods for forming hBN and cBN are known in the art. For example, known methods for forming hBN typically involve heating under a protective atmosphere, e.g. in a nitrogen flow, amorphous boron nitride at temperatures above 1500° C. Additionally, known methods for forming cBN typically involves subjecting hBN to similarly high temperatures (e.g. temperatures above 1200° C.) and concurrent high pressures (e.g. pressures above 2 GPa), often in the presence of one or more catalysts or fluxing agents.

As mentioned above, the hardness and chemical and thermal stability of cBN, makes cBN well suited for use as abrasive particles in cutting, grinding, polishing, and drilling media (e.g. tool inserts, twist drills, circular saws, grinding wheels, lapping belts, polishing pads, cutting tools, etc.). Further, cBN monocrystalline particles (e.g. single crystals of cBN) may be bonded together to form a cBN compact, also known as polycrystalline cBN (PCBN). Some or all of the single cBN crystals in a cBN compact may be self-bonded, bonded together with the aid of a bonding medium, or a combination thereof. Suitable bonding media may generally include a metal such as aluminum, cobalt, iron, nickel, platinum, titanium, chromium, tantalum, etc. or an alloy or mixture thereof. Further, a cBN compact may be bonded to a substrate material, such as cemented tungsten carbide, cemented titanium carbide, cemented tantalum carbide, etc.

While cBN and PCBN are widely used to machine materials such as cast iron, powder metal components and other similar materials that are difficult to machine, the cost to fabricate pure cBN and PCBN may be cost prohibitive. For example, the fabrication of both pure cBN and PCBN traditionally requires high temperatures and high pressures. Consequently, metal bonded, polymer bonded, and ceramic bonded cBN components have emerged.

Metal, polymer and ceramic bonded cBN components are generally implemented as grinding and polishing media, typically as coatings on a backing layer. However, polymer bonded cBN components generally suffer from low operating temperatures, and therefore are only capable of providing low material removal rates. Metal bonded cBN components may be capable of higher operating temperatures and therefore higher material removal rates, yet suffer from potentially damaging contamination from the metal binder.

SUMMARY

According to one embodiment, a composite product includes: a matrix material including hexagonal boron nitride and one or more borate binders; and a plurality of cubic boron nitride particles dispersed in the matrix material.

According to another embodiment, a composite product includes: a matrix material including hexagonal boron nitride and amorphous boron nitride; and a plurality of cubic boron nitride particles dispersed in the matrix material.

According to yet another embodiment, a composite product includes: a matrix material comprising hexagonal boron nitride and one or more borate binders, where at least one of the borate binders is present in a crystalline phase and at least one of the borate binders is present in an amorphous phase. The composite product additionally includes a plurality of cubic boron nitride particles dispersed in the matrix material.

Other aspects and advantages of the present invention will become apparent from the following detailed description, which, when taken in conjunction with the drawings, illustrate by way of example the principles of the invention.

BRIEF DESCRIPTION OF THE DRAWINGS

For a fuller understanding of the nature and advantages of the present invention, reference should be made to the following detailed description read in conjunction with the accompanying drawings.

DETAILED DESCRIPTION

Figure 1:
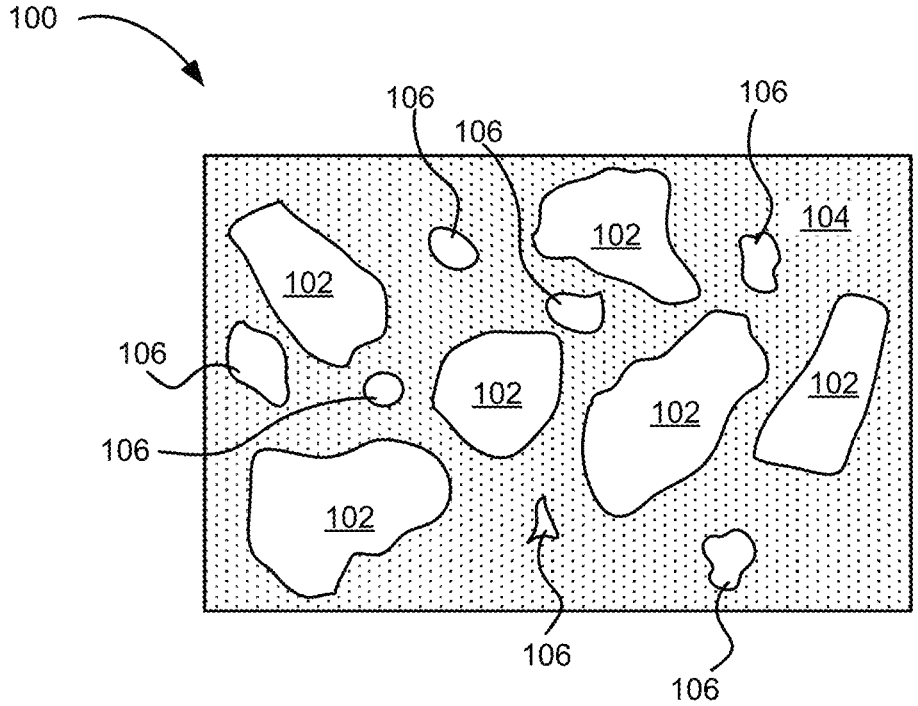
FIG. 1 shows a simplified representation of a composite product according to one embodiment.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

Further, as used herein, all percentage values are to be understood as percentage by volume (vol. %), unless otherwise noted. Moreover, all percentages by volume are to be understood as disclosed in an amount relative to the bulk volume of a composite product, in various approaches.

As also used herein, the term "about" when combined with a value refers to plus and minus 10% of the reference value. For example, a length of about 10 nm refers to a length of 10 nm±1 nm, a temperature of about 50° C. refers to a temperature of 50° C.±5° C., etc.

As additionally used herein, the term "conversion" refers to the change(s) in the crystal structure of the boron nitride. For example, under certain conditions (e.g. temperatures, pressures, etc.) amorphous boron nitride may be converted to hBN, hBN may be converted to cBN, etc.

Moreover, unless noted otherwise, reference to cBN in the composite products described below refers to monocrystalline cBN.

The following description discloses several preferred embodiments of composite materials comprising cubic boron nitride and/or related uses and methods of making the same.

As discussed above, cBN and PCBN are recognized for their superior machining, grinding and polishing characteristics. For instance, pure cBN and PCBN are widely used for difficult to machine materials such as cast iron, powder metal components, etc. However, the cost to fabricate pure cBN and PCBN may be cost prohibitive, as said fabrication traditionally requires high temperatures (e.g. temperatures above 1200° C.) and concurrent high pressures (e.g. pressures above 2 GPa).

Alternative metal bonded, polymer bonded, and ceramic bonded cBN components have thus emerged and are generally implemented as grinding and polishing media, typically as coatings on a backing layer. However, polymer bonded cBN components suffer from low operating temperatures, and therefore low material removal rates. While metal bonded cBN components may be capable of higher operating temperatures and therefore higher material removal rates, metal bonded cBN components suffer from potentially damaging contamination from the metal binder.

Embodiments disclosed herein overcome the aforementioned drawbacks by providing novel boron nitride composites and methods of making the same. In various approaches, these boron nitride composites comprise a plurality of cBN particle dispersed in a matrix component comprising hBN and/or one or more borate binders. It has been surprisingly found that these novel boron nitride composites comprising cBN particles dispersed in a softer phase of hBN with or without a borate binder may be used as effective and efficient cutting, polishing, drilling, and/or grinding tools. Such a result was indeed surprising given that hBN is the softest crystalline form of boron nitride and is typically used as a lubricant. Moreover, the material removal rate of tools comprising the novel boron nitride composites disclosed herein may also be tailored (e.g. increased) by controlling/adjusting the particle size and volume fraction of the cBN phase in some approaches.

Additionally, fabrication of the boron nitride composites disclosed herein may not require the addition of metal binders in other approaches. Further, fabrication of the boron nitride composites disclosed herein may require lower temperatures and/or lower pressures as compared to the fabrication of conventional pure cBN, and PCBN in more approaches. Accordingly, the novel boron nitride composites disclosed herein may avoid the lower material removal rates associated with polymer and ceramic bonded cBN components, the metal contamination problems associated with metal bonded cBN components, and the high costs associated with fabrication of pure cBN and HCB.

For example, in one general embodiment, a composite product includes hexagonal boron nitride (hBN), and a plurality of cubic boron nitride (cBN) particles, wherein the plurality of cBN particles are dispersed in a matrix of the hBN.

In another general embodiment, a composite product includes a plurality of cBN particles, and one or more borate-containing binders.

Referring now to FIG. 1, a composite product 100 is shown in accordance with one embodiment. As an option, the composite product 100 may be implemented in conjunction with features from any other embodiment listed herein, such as those described with reference to the other FIGS. Of course, the composite product 100 and others presented herein may be used in various applications and/or in permutations which may or may not be specifically described in the illustrative embodiments listed herein. Further, the composite product 100 presented herein may be used in any desired environment.

As shown in FIG. 1, the composite product 100 includes a plurality of cubic boron nitride (cBN) particles 102 and a matrix component 104 comprising hexagonal boron nitride ("hBN"), where the cBN particles 102 are dispersed in the matrix component 104. As discussed previously, the hardness of cBN is second only to diamond, whereas hBN is among the softest crystalline forms of boron nitride. Accordingly, the composite product 100 thus comprises a hard phase of cBN distributed/dispersed in a softer phase of hBN.

In some approaches, the cBN particles 102 may be present in the composite product 100 in an amount ranging from about 15 vol. % to about 90 vol. %. In more approaches, each of the cBN particles 102 may be a single cBN crystal. In even more approaches, an average particle size of some or all of the cBN particles 102 may be about 0.5 nm to about 250 microns. In further approaches, the morphology of the cBN particles 102 may comprise a spherical shape, a non-spherical shape e.g. an ellipsoid, a rectangle, tubular, a rod-like, etc.), an irregular shape, etc.

In numerous approaches, the composite product 100 may be employed as a tool (and/or for use in a tool) for cutting, grinding, polishing, etc. In such cases, the average particle size of the cBN particles 102 and/or the volume fraction of the cBN may affect the amount and rate at which the tool comprising the composite product 100 may remove material and the surface finish of the part. Moreover, the distribution of the cBN particle sizes in that average particle size range may also affect the material removal rate of a tool comprising the composite product 100. For instance, a composite product 100 comprising cBN particles with a narrow distribution of particle sizes (e.g. where there is minimal variation in particle size) in a first average particle size range may produce a cutting/polishing/grinding tool with a higher quality, more uniform and/or fine grit size as compared to a composite product 100 comprising cBN particles with a larger, more broad distribution of particles sizes in that first average particle size range. Moreover still, the composite product 100 may comprise cBN particles with two or more average sizes, which may also affect the overall efficacy (the amount of material able to be removed) and efficiency (rate of material removal) of the tool. Accordingly, in exemplary approaches, the average particle size(s) of the cBN particles 102, the distribution of cBN particle sizes, and/or the volume fraction of the cBN particles in the composite product 100 may be tailored/controlled to achieve the desired material removal rate of the tool.

As noted above, the cBN particles 102 may comprise particles with more than one average particle size. For example, in exemplary approaches, the cBN particles 102 dispersed in the matrix component 104 may be present in two average sizes, e.g. a first average cBN particle size (e.g. 102 in FIG. 1) and a second average cBN particle size (e.g. 106 in FIG. 1), where the second cBN particle size is smaller relative to the first cBN particle size. In such approaches, the second cBN particle size 106 may have an average particle size that is at least one order of magnitude smaller than the first average particle size 102. As used herein, an average particle size may be defined as the average particle diameter of at least 50% of the cBN particles in that particular particle size range. For instance, the first average cBN particle size may refer to the average particle diameter of at least 50% of the cBN particles having the first average particle size; the second average cBN particle size may refer to the average particle diameter of at least 50% of the cBN particles having the second average particle size, etc. In other approaches, a ratio of the volume fraction of cBN particles having the first average particle size to cBN particles having the second average particles size may be about 1:1 to about 10:1.

In approaches where the cBN particles 102 dispersed in the matrix component 104 may be present in two or more average sizes, the amount of the smaller of the average sizes may be tailored to achieve a desired hardness of the matrix.

In one approach, the matrix component 104 may also include one or more binders present in an amount ranging from about 2 vol. % to about 25 vol. %. In some approaches, the one or more binders may include one or more borates. In more approaches, the one or more borate binders may include borates with moderate melting points between about 500° C. to about 1200° C. In preferred approaches, the one or more binders may be selected from a group consisting of calcium borate, potassium borate, magnesium borate, lithium tetraborate, and combinations thereof. In numerous approaches, some or all of one or more binders may be present in a crystalline phase, an amorphous phase, a combination of amorphous and crystalline phases, etc.

In approaches where the matrix component 104 comprises hBN and one or more borate binders, the hard phase of cBN may be distributed/dispersed in the softer phase of the hBN plus borate binder matrix.

The matrix component 104 may be defined to comprise all components/ingredients excluding the cBN particles 102 in various approaches.

In some approaches, the matrix component 104 may solely consists of the hBN. In other words, in such approaches, no other matrix component, binder material, etc. other than the hBN may be present in the composite product 100.

Figure 2:
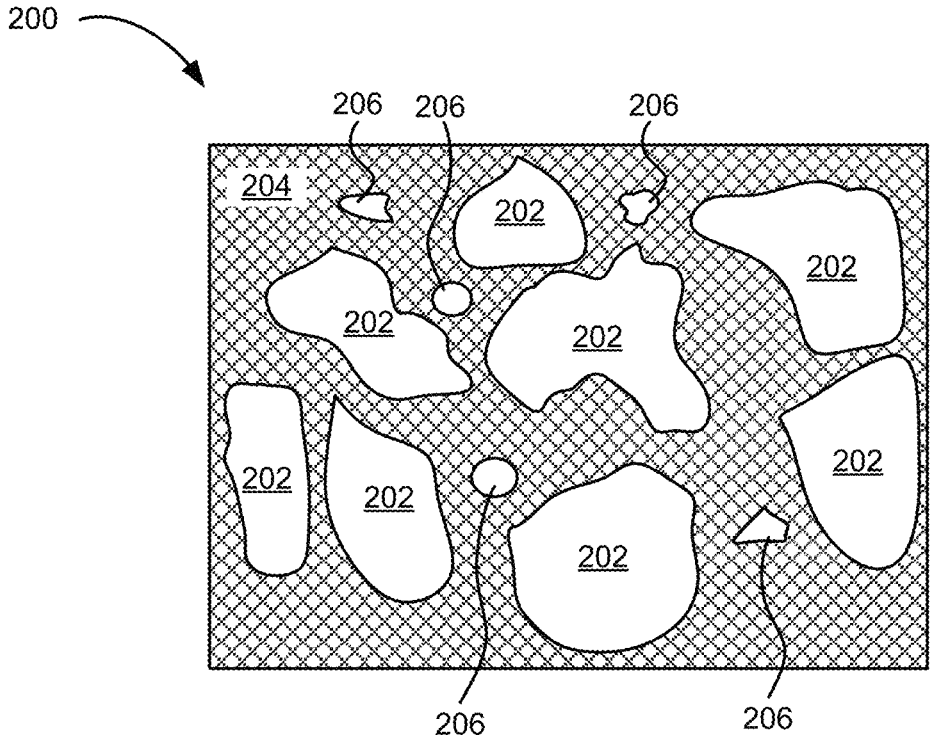
FIG. 2 shows a simplified representation of a composite product according to one embodiment.

Referring now to FIG. 2, a composite product 200 is shown in accordance with one embodiment. As an option, the composite product 200 may be implemented in conjunction with features from any other embodiment listed herein, such as those described with reference to the other FIGS. Of course, the composite product 200 and others presented herein may be used in various applications and/or in permutations which may or may not be specifically described in the illustrative embodiments listed herein. Further, the composite product 200 presented herein may be used in any desired environment.

As shown in FIG. 2, the composite product 200 includes a plurality of cBN particles 202 and a matrix component 204 comprising one or more borate binders. In some approaches, the cBN particles 202 may be present in the composite product 200 in an amount ranging from about 15 vol. % to about 90 vol. %. In various approaches, each of the cBN particles 202 may comprise a single cBN crystal. In more approaches, an average particle size of some or all of the cBN particles 202 may be about 0.5 nm to about 250 microns.

In one approach, the cBN particles 202 may comprise particles with more than one average particle size. For example, in exemplary approaches, the cBN particles 202 dispersed in the matrix component 204 may be present in two average sizes, e.g. a first cBN particle size (e.g. of particles 202 in FIG. 2) and a second cBN particle size (e.g. of particles 206 in FIG. 2). In such approaches, the second cBN particle size 206 may have an average particle size that is at least one order of magnitude smaller relative/compared to the first average particle size. In various approaches, a ratio of the volume fraction of cBN particles having the first average particle size to cBN particles having the second average particle size may be about 1:1 to about 10:1.

In one approach, the one or more borate binders may include borates with moderate melting points between about 500° C. to about 1200° C. In preferred approaches, the one or more binders may be selected from a group consisting of calcium borate, potassium borate, magnesium borate, lithium tetraborate, and combinations thereof. In numerous approaches, some or all of one or more binders may be present in a crystalline phase, an amorphous phase, a combination of amorphous and crystalline phases, etc.

In another approach, the matrix component 204 solely consists of the one or more borate binders. In other words, in such approaches, no other matrix component, binder material, etc. other than the one or more borate binders may be present in the composite product 200. In further approaches, the matrix component 204 is made of greater than 95 vol. % of the borate binder(s).

In yet another approach, the matrix component 204 may further include hBN. In some approaches where the composite product comprises the plurality of cBN, and a matrix component comprising both the one or more borate binders and hBN, the cBN may be present in the composite product 200 at about 15 vol. % to about 90 vol. %, and the one or more borate binders may be present in the composite product 200 at about 2 vol. % to about 25 vol. %, with the remainder hBN.

In a further approach, the matrix component 204 may comprise amorphous boron nitride (BN).

Figure 3:
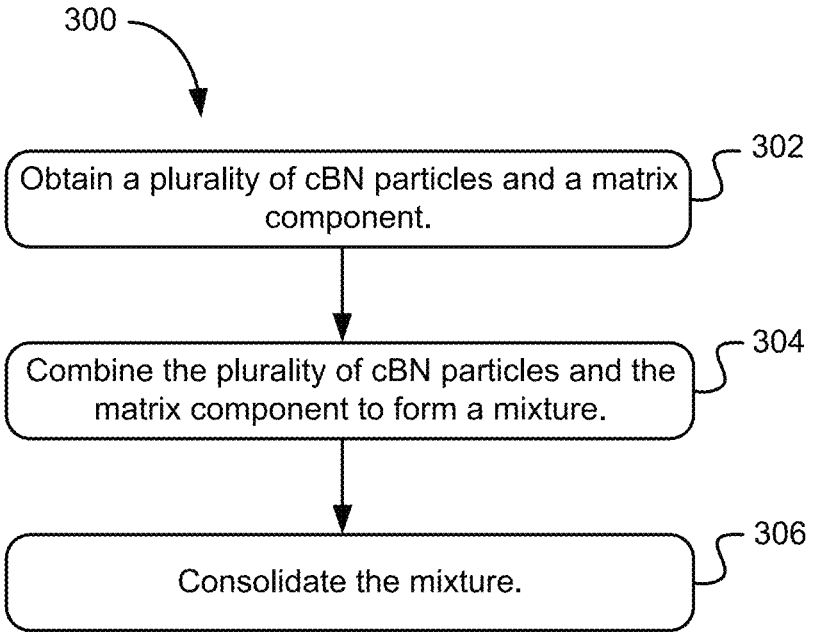
FIG. 3 shows a method for forming a composite product according to one embodiment.

Now referring to FIG. 3, a method 300 for forming a composite product is shown in accordance with one embodiment. As an option, the present method 300 may be implemented to form the composite products such as those shown in FIGS. 1-2 and others described herein. Further, the method 300 presented herein may be carried out in any desired environment. Moreover, more or less operations than those shown in FIG. 3 may be included in method 300, according to various embodiments. It should also be noted that any of the aforementioned features may be used in any of the embodiments described in accordance with the various methods.

As shown in FIG. 3, the method 300 includes obtaining a plurality of cBN particles and a matrix component. See operation 302. In preferred approaches, the cBN and matrix component may be obtained in powder form.

According to one embodiment, the matrix component may comprise hBN, amorphous BN, one or more borate binders, or a combination thereof. In various approaches, the one or more borate binders may include, but are not limited to, calcium borate, potassium borate, magnesium borate, lithium tetraborate, etc., and other such suitable borate binders as would be understood by one having ordinary skill in the art upon reading the present disclosure. In some approaches, it may be advantageous to add one or more borate binders to the matrix component in addition to the hBN, as such borate binders may facilitate the sintering and/or consolidation of the cBN particles and the matrix component(s) at lower temperatures to produce a final composite product (as described below).

In some approaches, the matrix component may consist only of hBN. In other approaches, the matrix component may consist only of the one or more borate binders. In yet other approaches, the matrix component may consist only of amorphous BN. In other approaches, the matrix component is made of greater than 95 vol. % of hBN, the borate binder(s), and/or the cBN.

It is of note that cBN powder, hBN powder and borate binders/sintering aids are readily and commercially available.

According to another embodiment, the plurality of cBN particles may have an average particle size of about 0.5 nm to about 250 microns. In further embodiments, the method 300 may include obtaining cBN particles comprising two average sizes, e.g. a first cBN particle size and a second cBN particle size, where the second cBN particle size is smaller relative to the first cBN particle size. As discussed previously, in some approaches, the second cBN particle size may be at least one order of magnitude smaller than the first average particle size. In more approaches, a ratio of the volume fraction of cBN particles having the first average particle size to cBN particles having the second average particle size may be about 1:1 to about 10:1.

As shown in FIG. 3, the method 300 also includes combining the plurality of cBN particles and the matrix component to form a mixture, and consolidating the mixture to form a composite product. See operation 304 and 306, respectively.

In various embodiments, the mixture may be consolidated using known consolidation techniques as would be recognized by one having skill in the art upon reading the present disclosure. For example, in some approaches, the consolidation of the mixture to form the composite product may involve consolidating the mixture at high pressure (high pressure sintering, "HPS"). Exemplary consolidation conditions for high pressure sintering may include the application of 1 GPa of pressure at a moderate temperature between about 900° C. to about 1300° C. (preferably about 1100° C. to about 1200° C.) for about 30 minutes. Consolidating the mixture using high pressure sintering may produce the composite product having a density of about 95% to about 100% of its Theoretical Maximum Density (TMD).

In more approaches, the mixture may be consolidated using a hot pressing technique. For instance, such a hot pressing technique may involve the application of uniaxial pressure to the mixture loaded into a graphite die, where application of the uniaxial pressure occurs at an elevated temperature. Exemplary consolidation conditions for hot pressing may include application of about 15 MPa to about 150 MPa of pressure at a moderate temperature between about 900° C. to about 1300° C. (preferably about 1100° C. to about 1200° C.) for about 5 minutes to about 120 minutes. Such hot pressing techniques may be advantageous as they are scalable, e.g. they resulting composite product may be produced in various sizes.

In even more approaches, the mixture may be consolidated using spark plasma sintering (SPS), also known as Field Assisted Sintering Technique (FAST) or Pulsed Electric Current Sintering (PECS). With SPS, the mixture may be loaded into a graphite die and heated by passing an electric current directly through the graphite die. Accordingly, SPS is different from hot pressing, as hot pressing typically heats the mixture in the graphite die by externally heating the graphite die. The low heat capacity of the graphite die allows rapid heating. Therefore, SPS can rapidly consolidate powders to near theoretical density through the combined actions of a rapid heating rate, and pressure application. Exemplary SPS consolidation conditions may include application of about 20 MPa to about 150 MPa of pressure at a moderate temperature between about 900° C. to about 1300° C. (preferably about 1100° C. to about 1200° C.) for about 5 minutes to about 30 minutes. Consolidating the mixture using SPS may produce the composite product having a density of about 95% to about 100% of its Theoretical Maximum Density (TMD).

It is of note that formation of the composite products disclosed herein using the above described consolidation techniques typically use lower temperatures and/or pressures as compared to the formation/consolidation of pure cBN and pure hBN. The formation of pure, consolidated cBN is a kinetically limited process, as cBN is metastable at room temperature and atmospheric pressure. Accordingly, typical processing and/or consolidation techniques to produce consolidated cBN generally involve the conversion of hBN to cBN using high temperature and high pressure conditions (e.g. 1200-2000° C., 2.5-5.0 GPa) in the present of fluxing agents and/or catalysts. In particular, several such methods of producing consolidating cBN involves high pressure sintering of hBN powder, which includes application of about 4 GPa (580 ksi) of pressure at about 1500° C., and/or application of about 2.5 GPa (360 ksi) of pressure at about 1000° C.

The consolidation of a pure hBN starting material (e.g. hBN powder) typically involves such techniques as hot pressing, isostatic pressing, pressureless sintering, etc. As noted above, hot pressing techniques generally involve the application of uniaxial pressure to a starting material, e.g. a powder, loaded in a graphite die at elevated and/or high temperatures. In contrast, isostatic pressing techniques generally involve compacting a material by applying pressure from multiple directions through a liquid or gaseous medium surrounding the compacted material, where the application of pressure from multiple directions usually results in greater uniformity of compaction and increased shape capability as compared to uniaxial pressing. There are two main types of isostatic presses: cold isostatic presses (CIP) that function at room temperature, and hot isostatic presses (HIP) that function at elevated and/or high temperatures. Hot pressing, isostatic pressing, pressureless sintering, etc. may all be performed in a controlled, inert atmosphere or under vacuum.

Consolidation of hBN via hot pressing may result in consolidated hBN with a density of about 85-98% of its TMD, however such hot pressing often involves application of up to 150 MPa of pressure and high temperatures between about 1500° C. to about 2000° C. Hot pressing hBN to achieve fully consolidated hBN may also involve the use of sintering aids and/or binders, in various approaches.

Moreover, consolidation of hBN via pressureless sintering may result in consolidated hBN with a density less than about 90% of its TMD, however pressureless sintering requires the use of sintering aids and/or binders, as well as high temperatures. For instance, pressureless sintering of hBN starting material may involve adding one or more sintering aids and/or binders to the hBN starting material, pre-pressing a part or all of the hBN starting material using uniaxial pressing and/or CIP, and heating the material to a high temperature between about 1800° C. to about 2000° C. in numerous approaches.

Again with reference to FIG. 3, the method 300 may additionally include shaping and/or milling the resulting composite product in some approaches. In various approaches the composite product may be shaped, milled, and/or molded to produce a desired size and shape of a cutting, grinding, polishing, drilling etc. tool. In more approaches the composite product, which may or may not be subject to a shaping process, a milling process, or other like process, may be bonded to a tool body via brazing or other suitable bonding techniques as would be understood by one having skill in the art upon reading the present disclosure.

Examples and Related Experimental Results

An example and related experimental results pertaining to the fabrication of composite products, such as those described herein, are presented below are presented below for illustrative purposes only. It is important to note that these illustrative examples are in no way limiting, and are presented by way of example only.

Fabrication of the exemplary composite products involves obtaining commercially available cBN powder and hBN powder, mixing the cBN powder and the hBN powder together to form a mixture, and consolidating the mixture using a consolidation technique selected from the group consisting of hot pressing, high pressure sintering, and spark plasma sintering to product a resulting consolidated, composite product.

Figure 4A:
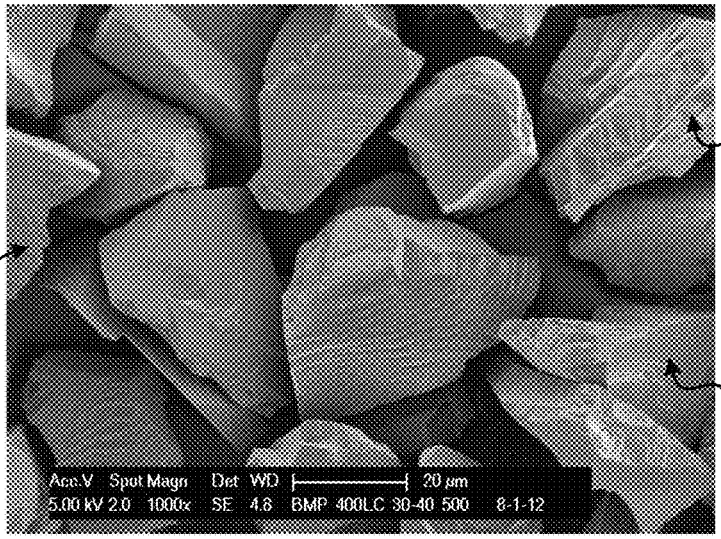
FIG. 4A shows an SEM image of cBN starting material with cBN particle sizes from about 30 to about 40 microns.
Figure 4B:
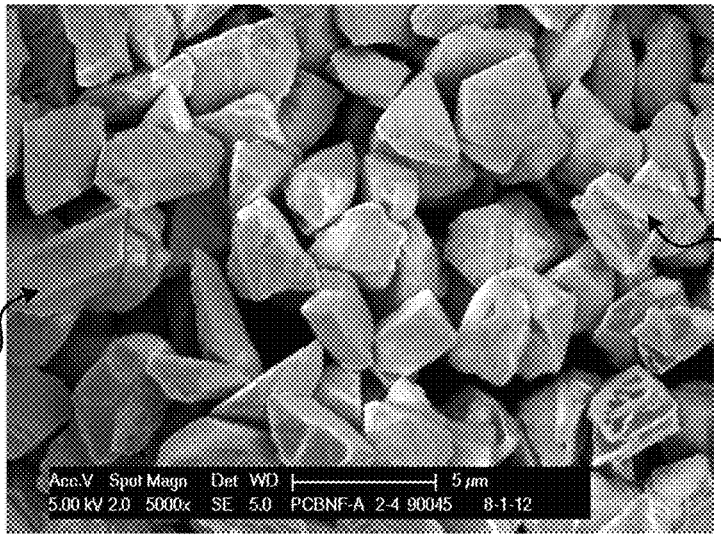
FIG. 4B shows an SEM image of cBN starting material with cBN particle sizes of ranging from about 2 to about 4 microns.
Figure 4C:
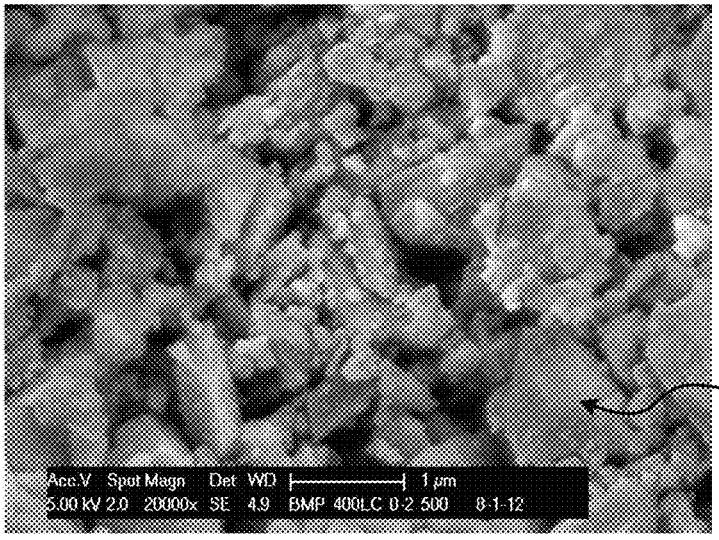
FIG. 4C shows an SEM image of cBN starting material with cBN particle sizes ranging from about 0 to about 2 microns.

FIGS. 4A-4C illustrate several images of the cBN starting material with cBN particle sizes ranging from about 30-40 microns, about 2-4 microns and about 0-2 microns, respectively, as characterized by a scanning electron microscopy (SEM). As shown in FIG. 4A-4C, each of the cBN particles (e.g. 402) comprises a single crystal of cBN. Where the composite material may be employed as, or in, a cutting, polishing, grinding, etc. tool, the cBN starting material with a particular average particle size, distribution of average sizes, etc. may be selected in order to achieve a desired grit size and/or material removal rate of the tool.

Figure 5:
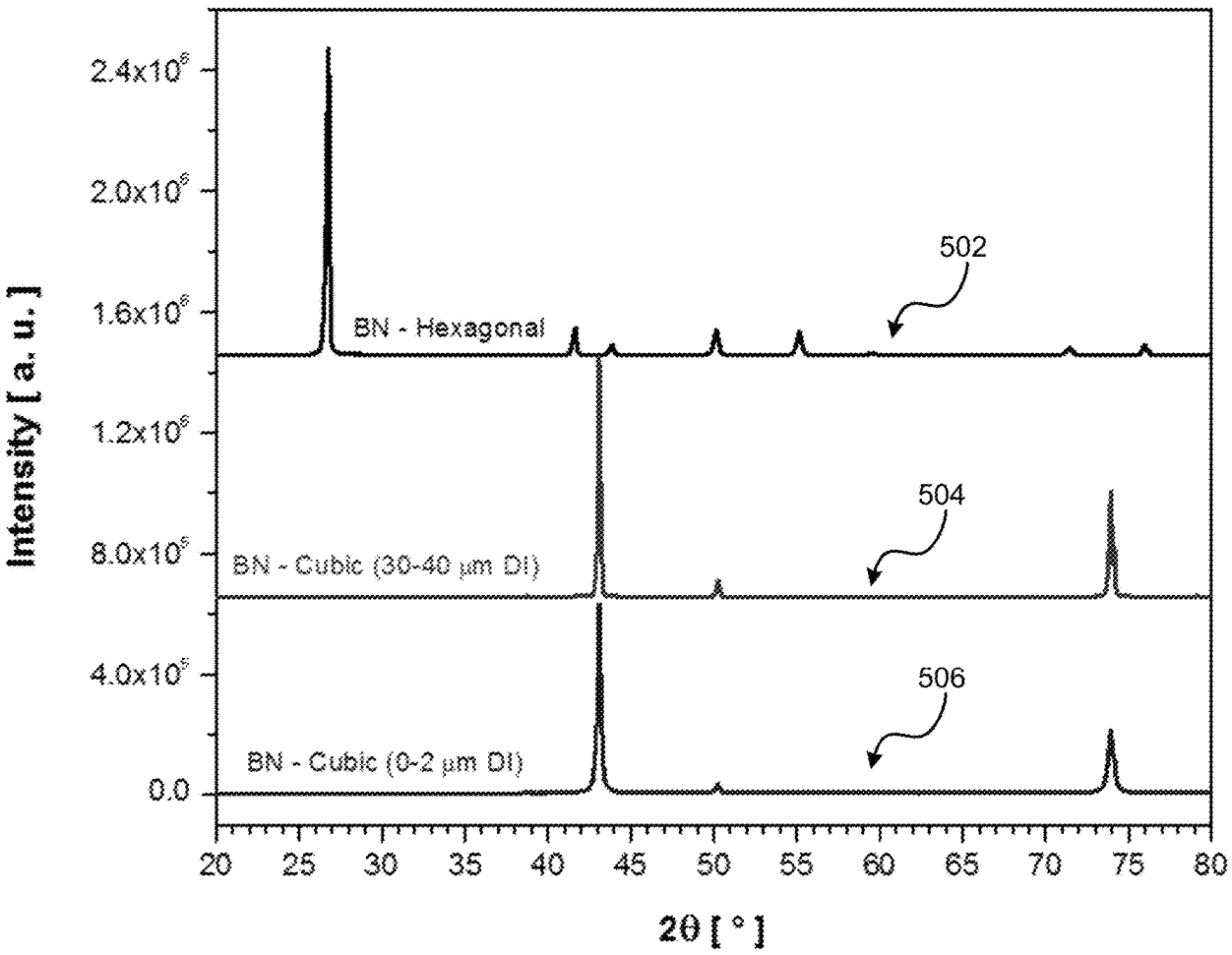
FIG. 5 shows x-ray diffraction (XRD) spectra corresponding to three different starting materials: hBN; cBN with a cBN particle size ranging from about 30 to about 40 microns; and cBN with a cBN particle size ranging from about 0 to about 2 microns.

FIG. 5 shows x-ray diffraction (XRD) spectra illustrating the crystallinity of the starting material used to fabricate a composite product, such as those disclosed herein. For instance, the XRD spectrum 502 corresponds to hBN starting material, the XRD spectrum 504 corresponds to cBN staring material having a cBN particle size ranging from between about 30 to about 40 microns, and the XRD spectrum 506 correspond to cBN having a cBN particle size ranging between about 0 to about 2 microns.

Figure 6:
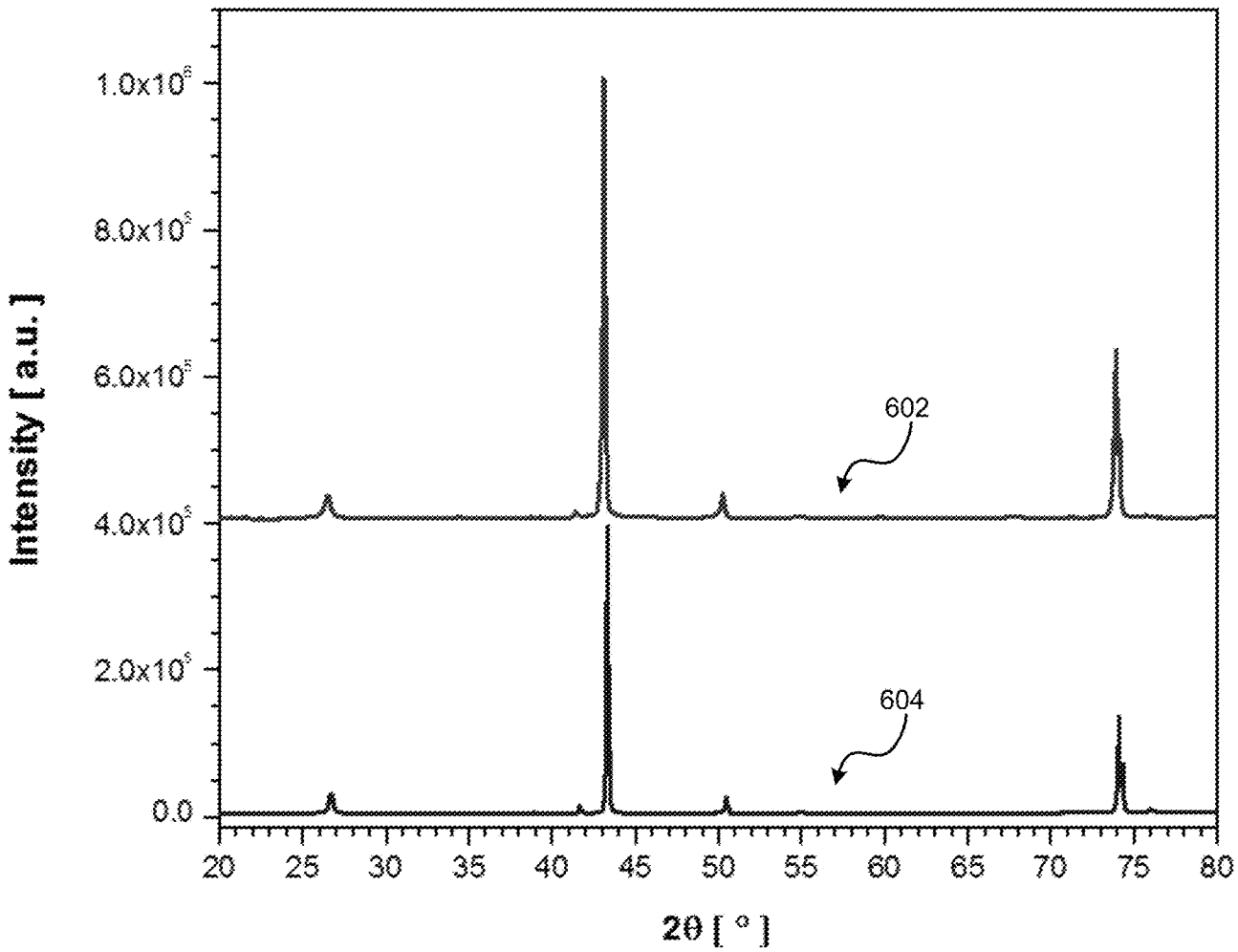
FIG. 6 shows XRD spectra for a mixture comprising hBN powder and cBN powder prior to and after a consolidation process.

FIG. 6 illustrates XRD spectra for the mixture prior to the consolidation process (e.g. XRD spectrum 602) and after the consolidation process (XRD spectrum 604). Prior to the consolidation process, the mixture illustrated in FIG. 6, was baked in a sample assembly to about 700° C. in a nitrogen atmosphere. In addition, the consolidation process involved heating the mixture to about 1300° C. for about 30 minutes. As shown in FIG. 6, no apparent decomposition of crystalline structure is observed in the resulting consolidated, composite product as compared to initial mixture prior to consolidation.

Figure 7:
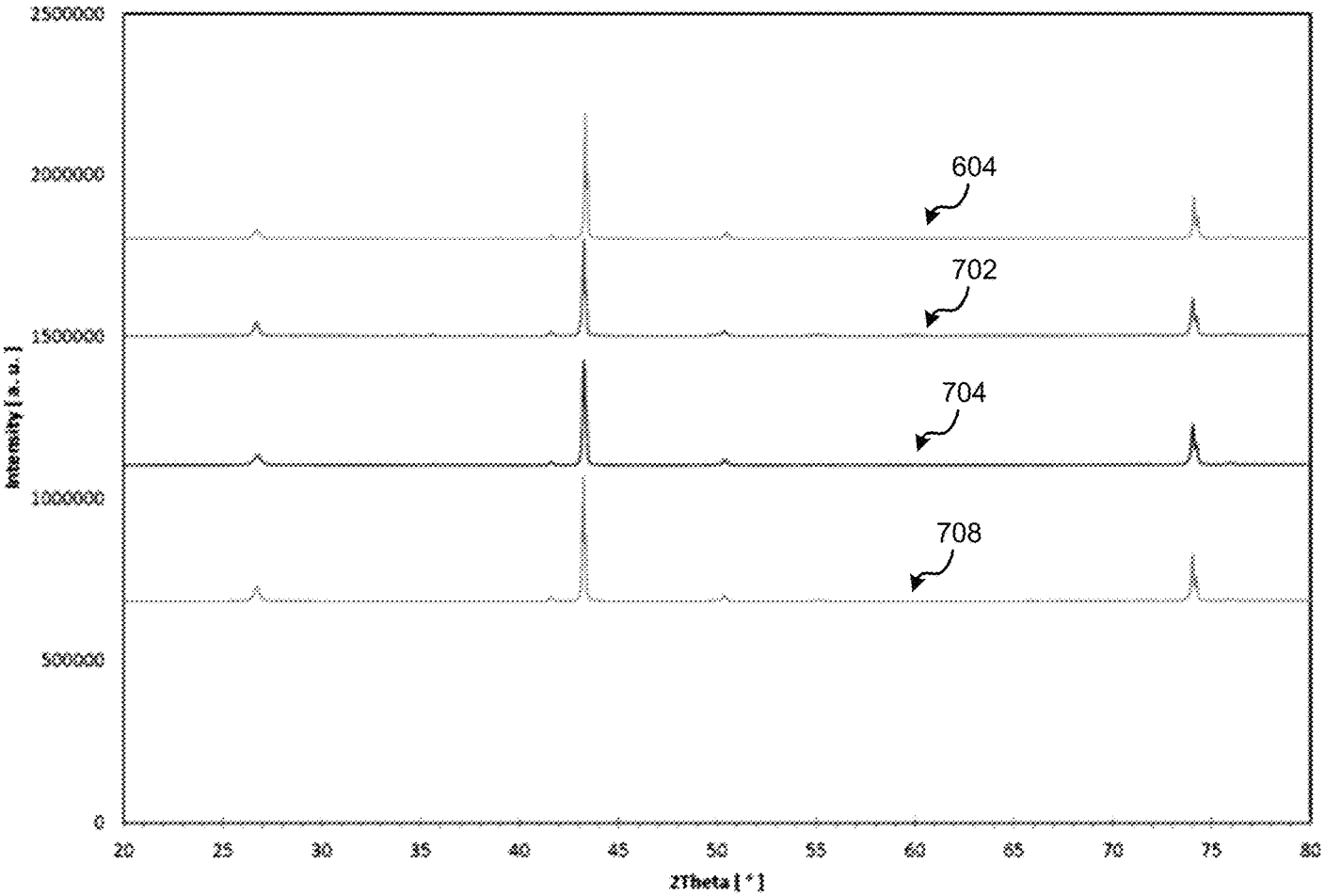
FIG. 7 illustrates XRD spectra for the mixture shown in FIG. 6 after consolidation at four different temperatures.

FIG. 7 illustrates XRD spectra for the mixture shown in FIG. 6 after consolidation at four different temperatures. The XRD spectrum 604 corresponding to the consolidated, composite product of FIG. 6 is reproduced in FIG. 7 for reference. XRD spectra 702, 704 and 706 correspond to consolidation temperatures of about 1000° C., 1100° C., 1200° C., respectively. As also shown in FIG. 7, no apparent decomposition of crystalline structure is observed in the resulting consolidated, composite product, even when produced via different consolidation temperatures, as compared to the initial mixture prior to consolidation (e.g. as shown in XRD 602 of FIG. 6).

Uses

Illustrative uses of various embodiments of the composite products disclosed herein may include, but are not limited to, application in various cutting, grinding, polishing, drilling, etc. media, as wells tools encompassing said media. In particular, composite products comprising a plurality of hard cBN particles dispersed in a matrix comprising hBN and/or one or more borate binders, may exhibit higher operating temperatures and therefor improved material removal rates as compared to conventional polymer bonded cBN products; and may also be free of metal contaminants that often are found in meta bonded cBN products. Moreover, fabrication of the composite products disclosed herein may involve use of lower consolidation temperatures and/or pressures, thereby resulting in an overall lower cost of fabrication, as compared to the fabrication of conventional cBN and PCBN products which require high temperatures (e.g. temperature >1200° C.) and concurrent high pressures (e.g. pressures >2.5 GPa).

While various embodiments have been described above, it should be understood that they have been presented by way of example only, and not limitation. Thus, the breadth and scope of an embodiment of the present invention should not be limited by any of the above-described exemplary embodiments, but should be defined only in accordance with the following claims and their equivalents.

What is claimed is:

1. A composite product, comprising:

a matrix material comprising hexagonal boron nitride (hBN) and one or more borate binders; and a plurality of cubic boron nitride (cBN) particles dispersed in the matrix material.

2. The composite product of claim 1, wherein the borate binders are each independently selected from the group consisting of: calcium borate, potassium borate, magnesium borate, lithium tetraborate, and combinations thereof.

3. The composite product of claim 1, wherein a total amount of the cBN particles is in a range from about 15 to about 90 vol. %.

4. The composite product of claim 1, wherein a total amount of the borate binders is in a range from about 2 to about 95 vol. %.

5. The composite product of claim 1, wherein an average particle size of the cBN particles is about 0.5 nm to about 250 microns.

6. The composite product of claim 1, wherein one or more of the cBN particles comprise a first average particle size and one or more of the cBN particles comprises a second average particle size, wherein the second average particle size is smaller than the first average particle size.

7. The composite product of claim 6, wherein a ratio of a volume percent of the cBN particles having the first average particle size to the cBN particles having the second average particle size is about 1:1 to about 10:1.

8. The composite product of claim 1, wherein each of the cBN particles is a single crystal of cBN.

9. A method of making the composite product of claim 1, comprising forming a mixture including the cBN particles, the hBN and the one or more borate binders;

consolidating the mixture by employing a consolidation technique selected from a group consisting of: high pressure sintering, spark plasma sintering and hot pressing.

10. A medium for at least one of cutting, grinding, polishing, and drilling, the medium comprising the composite product of claim 1.

11. A tool comprising the medium of claim 10.

12. A composite product, comprising:

a matrix material comprising hexagonal boron nitride (hBN) and amorphous boron nitride; and a plurality of cubic boron nitride (cBN) particles dispersed in the matrix material.

13. The composite product of claim 12, a total amount of the cBN particles is in a range from about 15 to about 90 vol. %.

14. The composite product of claim 12, wherein the matrix material comprises one or more borate binders in an amount ranging from about 2 to about 95 vol. %.

15. The composite product of claim 14, wherein the borate binders are each independently selected from a group consisting of calcium borate, potassium borate, magnesium borate, lithium tetraborate.

16. The composite product of claim 12, wherein the cBN particles comprise a first average particle size and a second average particle size, wherein the second average particle size is smaller than the first average particle size.

17. A composite product, comprising:

a matrix material comprising hexagonal boron nitride (hBN) and one or more borate binders, wherein at least one of the borate binders is present in a crystalline phase and at least one of the borate binders is present in an amorphous phase; and a plurality of cubic boron nitride (cBN) particles dispersed in the matrix material.

18. The composite product of claim 17, a total amount of the cBN particles is in a range from about 15 to about 90 vol. %.

19. The composite product of claim 17, wherein each of the cBN particles is a single crystal of cBN.

20. The composite product of claim 17, wherein a total amount of the borate binders is in a range from about 2 to about 95 vol. %.

* * * * *